United States Patent [19]

Espenscheid

[11] 4,089,773

[45] May 16, 1978

[54] LIQUEFACTION OF SOLID CARBONACEOUS MATERIALS

[75] Inventor: Wilton F. Espenscheid, Princeton, N.J.

[73] Assignee: Mobil Oil Corporation, New York, N.Y.

[21] Appl. No.: 746,451

[22] Filed: Dec. 1, 1976

[51] Int. Cl.[2] ..... C10G 1/04; C10B 57/06

[52] U.S. Cl. ..... 208/8; 201/2.5

[58] Field of Search ..... 208/8; 201/2.5

[56] References Cited

U.S. PATENT DOCUMENTS

| | | | |
|---|---|---|---|
| 3,617,474 | 11/1971 | Stotler | 208/10 |
| 3,642,607 | 2/1972 | Seitzer | 252/8 |
| 3,765,851 | 10/1973 | White | 201/2.5 |
| 3,791,957 | 2/1974 | Wolk | 208/10 |
| 3,983,027 | 9/1976 | McCollum et al. | 208/8 |
| 4,028,220 | 6/1977 | Urquhart | 208/8 |
| 4,030,893 | 6/1977 | Keller | 208/8 |

*Primary Examiner*—Delbert E. Gantz
*Assistant Examiner*—J. Thierstein
*Attorney, Agent, or Firm*—Charles A. Huggett; Carl D. Farnsworth

[57] ABSTRACT

This invention provides an improved process for solubilizing coal and other solid carbonaceous materials which involves heating a slurry of comminuted carbonaceous material and liquefaction solvent in contact with water, carbon monoxide, and a catalytic quantity of alkanol to produce a heavy oil or bitumen composition.

13 Claims, No Drawings

LIQUEFACTION OF SOLID CARBONACEOUS MATERIALS

BACKGROUND OF THE INVENTION

Wood and coal have been a principle source of fuel for hundreds of years. Within the last 100 years, petroleum has become the overwhelming primary commodity for the generation of energy. Petroleum has had the advantages of low cost and ease of transportation and storage because of its liquid consistency. Further, petroleum is readily amenable to fractionation and conversion into a variety of valuable industrial products such as fuels, building products, chemical intermediates, and the like.

Recent international economic developments have signaled the inevitable decline of petroleum as the world's supreme industrial commodity. The price of raw petroleum has increased several fold. Also, the consumption of petroleum has been increasing exponentially and concomitantly the world petroleum supply has diminished to less than several decades of proven reserves. Governments and industrial concerns on a priority basis are dedicating increased attention to alternatives to petroleum as sources for fuels and chemical intermediates.

It is known that coal and wood can be liquified by controlled heating in the substantial absence of oxygen. The conversion products are a liquid, gas and char. Representative prior art includes U.S. Pat. Nos. 3,379,638; 3,607,718; 3,640,816; 3,642,608; 3,705,092; 3,849,287; 3,870,621; inter alia.

The destructive distillation of wood to produce charcoal, oils and gases is also well known. It has been reported, for example, that as much as two barrels of oil per ton of tree bark can be obtained by a controlled pyrolysis process. The United States Bureau of Mines, in publication Number 8013 entitled "Conversion of Cellulosic Wastes to Oil," reports 90–99 weight percent conversion of sawdust with 40–60 weight percent yields of oil by reaction with synthesis gas at a temperature of 250°–425° C and a pressure of 1500–4000 psig, in the presence of water and an inorganic catalyst.

Because of compelling economic factors, the technology of coal liquefaction and gasification has been expanding at an accelerated pace. Pioneer developments in the field are represented by Lurgi and Fischer-Tropsch technology. More recent advances in coal liquefaction are described in U.S. Pat. Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

The primary product of such coal liquefaction processes is a mixture of liquid and undissolved solids. The liquid is a solution of coal solubilization products dissolved in the liquefaction solvent. Most of the undissolved solids may be readily separated from the liquid by conventional solid-liquid separation processes such as filtration, centrifugation, sedimentation, hydroclones, and the like.

The prior art provides various methods for the separation of coal liquefaction liquids from undissolved solids. Illustrative of the prior art pertinent to such solid-liquid separation methods are U.S. Pat. Nos. 2,060,447; 2,631,982; 2,774,716; 2,871,181; 2,964,460; 2,989,458; 3,010,893; 3,018,241; 3,275,546; 3,519,553; 3,598,118; 3,607,716; 3,607,717; 3,607,718; 3,607,719; 3,635,814; 3,642,608; 3,687,837; 3,791,956; and Def. Publ. No. 700,485. One of the objectives of the prior art processes is maximum recovery of a coal liquefaction product which is substantially free of mineral matter. Other objectives include sulfur and oxygen removal.

Also receiving high priority attention is the management of municipal, industrial and agricultural solid organic wastes, for reasons of environmental protection and natural resource conservation.

Techniques developed for lignite and cellulosics liquefaction are being studied for solid organic waste conversion. Appell et al. have reported the production of heavy oil by treatment of municipal solid waste with carbon monoxide and water at 380° C and 1500 psig pressure (Proc. Of The Nat. Ind. Solid Wastes Management Conference, pages 375–379, March 1970).

U.S. Pat. No. 3,714,038 describes a method of chemically changing solid waste material into useful organic products by pulping a mixture of organic and inorganic wastes in water to form a slurry, removing inorganics from the slurry, dewatering the slurry, and then either pyrolyzing or hydrogenating the dewatered slurry.

U.S. Pat. No. 3,864,096 discloses a process for converting cellulose into a normally liquid oil, which process consists of contacting the cellulose with water, a reducing gas and an ammonia-producing gas at 300–375° C and a pressure of 100–150 atmospheres.

Other processes for converting solid organic wastes into fuels and chemical products are described in U.S. Pat. Nos. 3,085,038; 3,910,775; 3,926,582; 3,933,577; and the references cited therein.

New programs are being initiated for the development of technology for the provision of carbonaceous fuel products which complement and enhance conventional petroleum or coal-derived energy sources. Alternate innovative processes are being sought which do not depend on high pressures or catalysts for efficient and economic conversion of materials such as solid organic wastes.

There remains a pressing need for new technology for the conversion of coal and organic wastes into high value liquid carbonaceous products to complement and to enhance conventional petroleum derived energy applications.

Accordingly, it is a main object of this invention to provide an improved method for converting solid carbonaceous materials into liquid derivatives having application as fuels.

It is another object of this invention to convert coal into a denitrified and desulfurized synthetic crude oil.

It is another object of the present invention to provide a process for liquefaction of solid carbonaceous materials without the use of high hydrogen pressures or conventional hydrogenation catalysts.

It is another object of the present invention to solubilize cellulosic waste materials such as cardboard and newsprint, grain husks, nut shells, and the like, to form flowable heavy oil or pitch-like compositions which are directly applicable as liquid fuels.

It is a further object of the present invention to upgrade low value refractory petroleum residua from refinery operations into liquid fuel media.

Other objects and advantages of the present invention shall become apparent from the accompanying description and examples.

DESCRIPTION OF THE INVENTION

One or more objects of the present invention are accomplished by the provision of a process for solubilization of solid carbonaceous material which comprises heating at a temperature between about 400° and 1200° F and a pressure between about 200 and 6000 psi a slurry of comminuted carbonaceous material and a hydrogen-donor liquefaction solvent in contact with water, a catalytic quantity of primary alkanol, and carbon monoxide.

The slurry is heated for a period of time between about 0.2 and 3 hours sufficient to convert the slurry into a homogeneous composition which has a flowable heavy oil or pitch-like consistency at 25° C.

The liquefaction solvent performs as a hydrogen-donor solvating medium. A preferred type of liquefaction solvent is a thermally stable, polycyclic aromatic and hydroaromatic mixture which results from one or more petroleum refining operations, or is an indigenous liquid fraction which is recycled in the invention process. The liquefaction solvent nominally has a boiling point in the range between about 450° F and 950° F. Materials boiling above about 1000° F which are derived from the invention process may also be employed as a part of the liquefaction solvent.

Illustrative of a suitable liquefaction solvent is a petroleum refinery highly aromatic residuum such as fluidized catalytic cracker (FCC) "main column" bottoms or thermofor catalytic cracker (TCC) "syntower" bottoms which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, tetralin, dihydronaphthalene, and the like. Such refractory petroleum media are resistant to conversion to lower molecular products by conventional nonhydrogenative procedures. Typically, these petroleum refinery residua and recycle fractions are hydrocarbonaceous mixtures having an average carbon to hydrogen ratio above about 1:1, and a boling point above about 450° F.

An FCC main column bottoms refinery fraction is a highly preferred solvent for the practice of the present invention process. A typical FCC main column bottoms (or FCC clarified slurry oil) contains a mixture of chemical constituents are represented in the following mass spectrometric analysis:

| Compounds | Aromatics | Naphthenic/ Aromatics | Labile $H_2$% |
|---|---|---|---|
| Alkyl-benzenes | 0.4 | | 0 |
| Naphthene-Benzenes | | 1.0 | 0.03 |
| Dinaphthene-Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene-phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 5.4 | | |
| Naphthobenzothiophenes | | 2.4 | 0.4 |
| Total | 64.4 | 35.6 | 0.60 |

A typical FCC main column bottoms has the following nominal analysis and properties:

| Elemental Analysis, Wt.% | |
|---|---|
| C | 89.93 |
| H | 7.35 |
| 0 | 0.99 |
| N | 0.44 |

-continued

| Elemental Analysis, Wt.% | |
|---|---|
| S | 1.09 |
| Total | 99.80 |
| Pour Point, ° F: | 50 |
| CCR, %: | 9.96 |
| Distillation: | |
| IBP, ° F: | 490 |
| 5%, ° F: | 800 (est.) |
| 95%, ° F: | 905 |

FCC main tower bottoms are obtained by the catalytic cracking of gas oil in the presence of a solid porous catalyst. A more complete description of the production of this petroleum fraction is disclosed in U.S. Pat. No. 3,725,240.

A FCC main column bottoms is an excellent liquefaction solvent medium for solubilization of carbonaceous materials because it has a unique combination of physical properties and chemical constituency. A critical aspect of solvating ability is the particular proportions of aromatic and naphthenic and paraffinic moieties characteristic of a prospective liquefaction solvent. A high content of aromatic and naphthenic structures in a solvent is a criterion for high solvating ability for liquefaction of carbonaceous material.

The solvating ability of a liquefaction solvent can be expressed in terms of specific types of hydrogen content as determined by proton nuclear magnetic resonance spectral analysis. Nuclear magnetic resonance characterization of heavy hydrocarbon oils is well developed. The spectra (60$\mu$ c/sec) are divided into four bonds ($H_{60}$, $H_{62}$, $H_\gamma$ and $H_{Ar}$) according to the following frequencies in Hertz (Hz) and chemical shift ($\delta$):

| | $H_\alpha$ | $H_{62}$ | $H_\gamma$ | $H_{Ar}$ |
|---|---|---|---|---|
| Hz | 0–60 | 60–100 | 120–200 | 360–560 |
| $\delta$ | 0–1.0 | 1.0–1.8 | 2.0–3.3 | 6.0–9.2 |

The $H_{Ar}$ protons are attached to aromatic rings and are a measure of aromaticity of a solvent. $H_{60}$ protons are attached to non-aromatic carbon atoms attached directly to an aromatic ring structure, e.g., alkyl groups and naphthenic ring structures. $H_{62}$ protons are attached to carbon atoms which are in a second position away from an aromatic ring, and $H_{65}$ protons are attached to carbon atoms which are in a third position or more away from an aromatic ring structure.

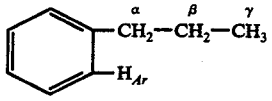

The $H_{Ar}$ protons are important because of their strong solvency power. A high content of $H_{60}$ protons is particularly significant in a liquefaction solvent, because $H_{60}$ protons are labile and are potential hydrogen doners in a carbonaceous material liquefaction process. $H_\beta$ and $H_\gamma$ protons are paraffinic in nature and do not contribute to the solvating ability of a liquefaction solvent.

It is particularly preferred that the liquefaction solvent employed in the present invention process has a hydrogen content distribution in which the $H_{Ar}$ proton content is between about 30 and 50 percent, the $H_{60}$ proton content is at least about 30 percent and the $H_\alpha/H_\beta$ proton ratio is above about 1.4. Concomitantly it is desirable that the $H_\beta$ proton content is below 20 percent and the $H_\gamma$ proton content is below 13 percent.

The carbonaceous materials which are amenable to the present invention solubilization process include bituminous and sub-bituminous types of coal. The nominal analyses of various coals suitable for use in the invention process are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53 |
| Nitrogen | 0.74 |
| Oxygen | 32.04 |
| Carbon | 54.38 |
| Hydrogen | 5.42 |
| Ash | 5.78 |

Ball mills or other types of conventional apparatus can be employed for pulverizing coarse coal in the preparation of comminuted feed coal for the invention process. The crushing and grinding of the coal can be accomplished either in a dry state or in the presence of a liquid such as water or the liquefaction solvent being employed in the practice of the invention process. The average particle diameter of the feed coal is preferably below about 0.05 inches.

The present invention process is generally applicable to solid carbonaceous materials such as wood and other forms of cellulosics, scrap plastics and rubbers, textile cuttings, and the like.

Solid organic materials (e.g., cellulosics and plastics) amenable to the present invention process are readily available in abundant supply in the form of accumulated municipal, industrial and agricultural waste products.

Cellulosic agricultural wastes are derived in the form of wheat straw, rice straw, rye straw, maize husks and stalks, sugar cane bagasse, and the like.

Municipal waste organic materials include refuse and sewage sludge. The composition of municipal refuse consists substantially of cellulosic products such as cardboard, newsprint and other forms of paper. Excluding moisture, metals and siliceous materials, the cellulosic content of municipal refuse is usually above 90 percent. Table I illustrates the content of a typical municipal refuse composition. The Table I data is by Kaiser, E. R., "Refuse Reduction Process" reported in "Proceedings, the Surgeon General's Conference on Solid Waste Management for Metropolitan Washington," U.S. Public Health Service Publication No. 1729, Government Printing Office, Washington, D.C. July 1967, p. 93.

TABLE I

EAST COAST MUNICIPAL REFUSE COMPOSITION

| | | | |
|---|---|---|---|
| Cardboard | 7% | Moisture | 28.0% |
| Newspaper | 14 | Carbon | 25.0 |
| Miscellaneous Paper | 25 | Hydrogen | 3.3 |
| Plastic Film | 2 | Oxygen | 21.1 |
| Leather, molded plastics, rubber | | Nitrogen | 0.5 |
| Garbage | 12 | Sulfur | 0.1 |
| Grass and dirt | 10 | Glass, Ceramics, etc. | 9.3 |
| Textiles | 3 | Metals | 7.2 |
| Wood | 7 | Ash, other inerts | 5.5 |
| Glass, Ceramics, Stone | 10 | Total | 100.0 |
| Metallics | 8 | | |
| Total | 100.0 | | |

It is an advantage of the present invention process that the solid carbonaceous waste material being solubilized does not require extensive pretreatment before admixture with the liquefaction solvent medium. A solid urban waste or agricultural waste is subjected to a shredding and macerating procedure and then introduced directly into the invention liquefaction system.

If more elaborate pretreatment of the solid waste feed is advantageous, a gross separation of combustible and non-combustible materials can be effected by methods and equipment known in the art. Suitable solid waste pretreatment systems are described in U.S. Pat. Nos. 3,714,038 and 3,933,577.

In a typical pretreatment procedure, solid waste is admixed with water and subjected to a pulping action. The effluent slurry is then passed through liquid cyclone and coarse screen zones to remove glass, stone, metal, and the like. The pulp slurry is dewatered prior to the present invention liquefaction processing to remove any water that exceeds the quantity required as a reaction component in the invention process.

The liquefaction solvent component of the invention process is provided in a quantity between about 0.5 and 10 parts by weight per part by weight of the comminuted solid carbonaceous material being solubilized. Normally, the preferred ratio will be in the range between about 1.0 and 5 parts by weight of liquefaction solvent per part by weight of solid carbonaceous material.

The water component of the invention process is provided in a quantity between about 0.01 and 2.0 parts by weight per part by weight of the solid carbonaceous component. As it is apparent, the inclusion of water into the liquefaction system can be accomplished in several ways. For example, if the solid carbonaceous component is comminuted raw coal in a dry state, then the desired quantity of water component is specifically introduced into the liquefaction admixture. If the coal has been pulverized in an aqueous medium during the preparation stage, then the adhering moisture (e.g., about 1–4 weight percent) is sufficient for the purpose of the present invention process. It is important to note that in the case where the carbonaceous component is a cellulosic or other oxygen-containing material, water is generated in situ during the liquefaction process. The quantity of water generated in situ generally is sufficient to satisfy the stoichiometric requirements of the liquefaction process.

An important aspect of the present invention process is the inclusion of a catalytic quantity of an alcohol component, e.g., an alkanol, into the liquefaction medium. The presence of the alcohol component in a catalytic quantity increases the efficiency of the liquefaction process and enhances the yield of desirable oil products. The preferred type of alcohol component is a primary alkanol containing between 1 and about 5 carbon atoms. Illustrative of primary alkanols are methanol, ethanol, propanol, butanol, pentanol, ethylene glycol, and the like. Methanol is a highly preferred catalyst since it can be readily obtained by the reaction of coal or byproduct char with water.

The alcohol component is provided in the invention process in a quantity sufficient to catalyze the dissolution of the solid carbonaceous component into the liquefaction solvent. The quantity of alcohol component can vary in the range between about 0.1 and 10 weight percent, and preferably between about 0.5 and 5 weight percent, based on the weight of solid carbonaceous component.

The alcohol catalytic effect is believed to proceed in accordance with the following type of reaction mechanism:

$$R{-}OH + CO \rightarrow H{-}CO_2{-}R$$

$$H{-}CO_2{-}R + H_2O \rightarrow R{-}OH + H{-}CO_2{-}H$$

$$H{-}CO_2{-}H + \text{coal} \rightarrow H{-}\text{coal} + CO_2$$

$$\text{Net: } CO + H_2O + \text{coal} \rightarrow H{-}\text{coal} + CO_2$$

Also essential for the practice of the invention process is the presence of a partial pressure of carbon monoxide in the closed liquefaction system. The partial pressure of carbon monoxide can vary over a broad range, and preferably is maintained at a partial pressure level which is at least about 20 percent of the total pressure of the gasiform mixture. Low BTU synthesis gas provides an economical and convenient source of carbon monoxide feed stream.

As the liquefaction of solid carbonaceous component proceeds under the invention process conditions, the pressure of the closed system increases several fold because of the generation of gasiform materials such as carbon dioxide, hydrogen, hydrogen sulfide, ammonia, methane, water, and the like.

In the practice of the invention process, the liquefaction solvent and comminuted carbonaceous material are admixed to form a slurry. If desired, the slurry can be pre-heated in a first step to solubilize substantially the carbonaceous material before contacting the liquefaction medium with the water, alcohol catalyst, and carbon monoxide components of the process.

In a preferred embodiment, the liquefaction solvent, comminuted carbonaceous material, water, and alcohol catalyst are charged to a reactor, and the reactor is pressurized with carbon monoxide or a carbon monoxide-containing gasiform stream. The liquefaction system is heated at a temperature between about 400° and 1200° F, and preferably between about 500°and 800° F. The pressure is maintained in the range between about 200 and 6000 psi, and preferably between about 500 and 5000 psi.

In the liquefaction process, the slurry is heated for a reaction time sufficient to yield a heavy oil or pitch-like composition which upon cooling to ambient temperatures remains homogeneous and has a flowable consistency. The heating step of the invention process is conducted for a period of time between 0.2 and 3 hours, and preferably for a period of time between about 0.5 and 1.5 hours.

At the conclusion of the solubilization step, heavy solids can be removed in a settler, and if desired, suspended solids can be separated from the liquefaction medium by centrifugation or filtration. Gaseous products are recovered when the closed system is vented.

The homogeneous heavy oil or bitumen compositions which are the resultant products of the present invention process can be directly utilized as liquid fuel, such as in heavy oil fired stationary power generators. It is an important advantage of the present invention that the preferred compositions which are produced meet the specifications of No. 6 fuel oil. If desired, the invention compositions can be deashed (e.g., by filtration, centrifugation, selective precipitation, and the like) to yield a fuel which meets the specifications of the more valuable No. 5 fuel oil. Nominally, the net content of sulfur, nitrogen and oxygen elements in an invention liquefaction composition is substantially lower than that of a comminuted carbonaceous raw material which is solubilized in the practice of the invention process.

It is also within the scope of this invention to modify the physical properties of the homogeneous heavy oil or bitumen compositions by one or more additional procedures. For example, cutting stock can be added in variable proportions to change the flow characteristics of the compositions. Suitable cutting stocks include kerosene and light gas oil fractions. The compositions can be diluted with cutting stocks over a broad range of between about 0.1 and 10 volumes of cutting stock per volume of invention composition. The inclusion of cutting stock facilitates filtration or other separation means employed to separate the solids phase of ash and other insoluble materials from the fluid liquefaction phase.

It is another embodiment of this invention to subject the products of the invention process to modification by steps which include (1) deashing and the removal of other insoluble solids; and (2) removal of the liquefaction solvent component by distillation to yield solvent-refined hydrocarbonaceous derivatives. The liquefaction solvent component is recycled to the first step of the process. The light end fractions are useful as fuel, and alcohol catalyst is recovered and recycled.

It is a further embodiment of this invention to subject the recovered heavy oil or bitumen products to a coking operation or to petroleum refinery upgrading to premium motor fuels.

The following examples are further illustrative of the present invention. The reactants and other specific ingredients are presented as being typical, and various modifications can be derived in view of the foregoing disclosure within the scope of the invention.

EXAMPLE I

A. A 1-liter autoclave equipped with a stirrer was charged with 60 grams of dried high volatile A bituminous coal, 120 grams of Torrance FCC main column bottoms, 10 grams of water, and 5 milliliters of methanol. The autoclave was pressurized to 80 psig with carbon monoxide.

The autoclave reactor was heated to 750° F and maintained at this temperature for one hour. During the heating period, the reactor pressure increased to 3200 psig and then gradually decreased to 2400 psig.

The reactor was then quench-cooled and the contents were classified by their solubility in pyridine, benzene, and hexane. The puridine-insoluble fraction contained the ash and unreacted coal. The pyridine-soluble/benzene insoluble fraction constituted the coal-derived asphaltenes. The benzene-soluble/hexane insoluble fraction contained the coal-derived oils.

B. For comparison purposes, the reaction procedure above was repeated with the exception that the water, carbon monoxide and methanol components were excluded. The results of the comparison procedures were as follows:

| Yield, wt.%[1] | A | B |
|---|---|---|
| Pyridine-insoluble | 3.6 | 18.6 |
| Benzene-soluble | 31.1 | 16.0 |
| Benzene-insoluble | 62.1 | 56.0 |
| Water | (2) | 3.1 |
| Gas | (2) | 6.3 |
| Conversion, wt.%[1] | 96.4 | 81.4 |

[1]Wt.% of m.a.f. coal, solvent-free basis.
[2]Admixture with original water and gas components.

Procedure A in accordance with the present invention process yielded a greater quantity of benzene-soluble oils than procedure B.

EXAMPLE II

A. In the manner of EXAMPLE I, 60 grams of dried Douglas Fir sawdust (<12 mesh), 120 grams of Torrance FCC main column bottoms, and 5 milliliters of methanol were charged to an autoclave reactor. The reactor was pressurized to 500 psig with carbon monoxide, and heated up to 650° F and maintained at this temperature for one hour. During the period of heating, the pressure increased to 3050 psig and then decreased to about 2100 psig. The product mixture was classified on the basis of solubility characteristics.

B. For comparison purposes, the reaction procedure above was repeated with the exception that the carbon monoxide and methanol were excluded. The results of the comparison procedures were as follows:

| Yield, wt.% | A | B |
|---|---|---|
| Pyridine-insoluble | 0.6 | 0.6 |
| Benzene-soluble | 30.6 | 9.8 |
| Benzene-insoluble | 34.6 | 39.3 |
| Water | — | 20.8 |
| Gas | — | 15.2 |
| Conversion, wt.% | 99.4 | 99.4 |

The present conversion was excellent with both procedures, but procedure A in accordance with the present invention process yielded a significantly larger quantity of benzene-soluble oils than procedure B.

What is claimed is:

1. In a process for dissolution of solid carbonaceous material the improvement which consists essentially of heating at a temperature between about 400° and 1200° F and a pressure between about 200 and 6000 psi a slurry of comminuted carbonaceous material and a petroleum refinery highly aromatic residuum hydrogen-donor liquefaction solvent in contact with water, a catalytic quantity of primary alkanol, and carbon monoxide.

2. A process in accordance with claim 1 wherein the slurry of comminuted carbonaceous material and liquefaction solvent is pre-heated until the carbonaceous material is substantially solubilized before contacting the said slurry with the water, primary alkanol, and carbon monoxide components.

3. A process in accordance with claim 1 wherein the solid carbonaceous material is coal.

4. A process in accordance with claim 1 wherein the solid carbonaceous material is at least partly municipal refuse.

5. A process in accordance with claim 1 wherein the solid carbonaceous material is at least partly sewage sludge.

6. A process in accordance with claim 1 wherein the solid carbonaceous material is at least partly cellulosic waste.

7. A process in accordance with claim 1 wherein the liquefaction solvent has a boiling point in the range between about 450° and 950° F.

8. A process in accordance with claim 1 wherein the liquefaction solvent is a FCC main column bottoms.

9. A process in accordance with claim 1 wherein the liquefaction solvent is a FCC clarified slurry oil.

10. A process in accordance with claim 1 wherein the liquefaction solvent is a TCC syntower bottoms.

11. A process in accordance with claim 1 wherein the primary alkanol is present in a quantity between about 0.1 and 10 weight percent, based on the weight of solid carbonaceous material.

12. A process in accordance with claim 1 wherein the primary alkanol is methanol.

13. A process in accordance with claim 1 wherein the carbon monoxide partial pressure is maintained at a level of at least about 20 percent of the total pressure.

* * * * *

UNITED STATES PATENT AND TRADEMARK OFFICE

CERTIFICATE OF CORRECTION

PATENT NO. : 4,089,773

DATED : May 16, 1978

INVENTOR(S) : WILTON F. ESPENSCHEID

It is certified that error appears in the above-identified patent and that said Letters Patent are hereby corrected as shown below:

| | |
|---|---|
| Column 2, line 56 | After "shells," add --bagasse,--. |
| Column 4, line 33 | "($H_{60}$, $H_{62}$, $H_{\gamma}$ and $H_{Ar}$)" should be --($H_{\alpha}$, $H_{\beta}$, $H_{\gamma}$ and $H_{Ar}$)--. |
| Column 4, line 37 | In the heading "$H_{62}$" should be --$H_{\beta}$--. |
| Column 4, line 42 | "$H_{60}$" should be --$H_{\alpha}$--. |
| Column 4, line 45 | "$H_{62}$" should be --$H_{\beta}$--. |
| Column 4, line 47 | "$H_{65}$" should be --$H_{\gamma}$--. |
| Column 4, line 57 | "$H_{60}$" should be --$H_{\alpha}$--. |
| Column 4, line 58 | "$H_{60}$" should be --$H_{\alpha}$--. |
| Column 4, line 66 | "$H_{60}$" should be --$H_{\alpha}$--. |
| Column 5, line 66 (Table I) | Next to "Leather, molded plastics, rubber" add --2--. |

UNITED STATES PATENT AND TRADEMARK OFFICE

CERTIFICATE OF CORRECTION

PATENT NO. : 4,089,773

DATED : May 16, 1978

INVENTOR(S) : WILTON F. ESPENSCHEID

It is certified that error appears in the above-identified patent and that said Letters Patent are hereby corrected as shown below:

| | |
|---|---|
| Column 6, line 50 | "purpose" should be --purposes--. |
| Column 8, line 59 | "puridine" should be --pyridine--. |
| Column 9, line 38 | "present" should be --percent--. |

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*